US007119677B2

(12) United States Patent
Ziesing

(10) Patent No.: US 7,119,677 B2
(45) Date of Patent: Oct. 10, 2006

(54) PERSONAL MONITORING SYSTEM

(75) Inventor: Marcus Ziesing, Lannerstrasse 6, 80638 Munich (DE)

(73) Assignee: Marcus Ziesing, Munich (DE)

( * ) Notice: Subject to any disclaimer, the term of this patent is extended or adjusted under 35 U.S.C. 154(b) by 0 days.

(21) Appl. No.: 10/381,862

(22) PCT Filed: Sep. 10, 2001

(86) PCT No.: PCT/EP01/10455

§ 371 (c)(1),
(2), (4) Date: Aug. 25, 2003

(87) PCT Pub. No.: WO02/27683

PCT Pub. Date: Apr. 4, 2002

(65) Prior Publication Data

US 2004/0046657 A1 Mar. 11, 2004

(30) Foreign Application Priority Data

Sep. 28, 2000 (DE) ..... 200 16 782 U

(51) Int. Cl.
*G08B 1/08* (2006.01)

(52) U.S. Cl. ..... 340/539.15; 340/539.21; 340/539.23; 340/573.1; 340/692

(58) Field of Classification Search ..... 340/539.15, 340/539.21, 539.23, 573.1
See application file for complete search history.

(56) References Cited

U.S. PATENT DOCUMENTS

| | | | | |
|---|---|---|---|---|
| 4,785,291 | A * | 11/1988 | Hawthorne | 340/573.4 |
| 5,115,223 | A * | 5/1992 | Moody | 340/573.1 |
| 5,289,163 | A | 2/1994 | Perez et al. | 340/539.32 |
| 5,486,814 | A * | 1/1996 | Quinones | 340/573.6 |
| 5,771,002 | A | 6/1998 | Creek et al. | 340/539.21 |
| 5,841,352 | A | 11/1998 | Prakash | 340/573.1 |
| 5,900,817 | A * | 5/1999 | Olmassakian | 340/573.1 |
| 6,084,517 | A | 7/2000 | Rabanne et al. | 340/573.4 |

FOREIGN PATENT DOCUMENTS

| | | |
|---|---|---|
| DE | 201 04 550 U1 | 7/2001 |
| EP | 0 989 532 A1 | 3/2000 |

* cited by examiner

*Primary Examiner*—Donnie L. Crosland
(74) *Attorney, Agent, or Firm*—Sierra Patent Group, Ltd.

(57) ABSTRACT

A system for monitoring movement of a person. The system includes a mobile transmitter that is affixed to the person to be monitored. The transmitter transmits radio signals to a receiver that may be used to track the person. The receiver may include an indicator that shows when the receiver is proximate the person. The indicator changes intensity as the distance between the transmitter and receiver changes.

24 Claims, 2 Drawing Sheets

PERSONAL MONITORING SYSTEM

The present invention relates to a system for the monitoring of persons, in particular of children and of adults requiring supervision.

It is known that above all small children like to explore their surroundings and run away from their supervising person to do so. The risk exists that the children run away and become lost or run into danger.

Children must therefore be taken by the hand or permanently watched. Taking them by the hand has a very negative effect on the desire for independence of the children, while the permanent watching is strenuous and is often not possible. Retaining reins have therefore become known which can be fastened to the child's hand in the manner of a leash and can be held by the supervising person. The monitoring is admittedly simplified by this. The mobility of the child is, however, also relatively greatly limited here.

It is the underlying object of the invention to provide a system of the kind initially named which does not have these disadvantages. In particular, an uncomplicated monitoring should be combined with a radius of movement of the child which is as wide as possible.

This object is satisfied by a system for the monitoring of persons, in particular of children and of adults requiring supervision, comprising a portable transmitter, a receiver and a warning device provided at the receiver as well as means by which the warning device is caused to output a warning signal when the distance between the transmitter and the receiver exceeds a pre-determined, in particular an adjustable, value.

By dispensing with a mechanical holding means, the mobility of the child or of the adult requiring supervision is not restricted. At the same time, no constant watching of the child or of the adult is necessary since a warning signal is output as soon as the child or the adult goes further away than what corresponds to the pre-determined value.

The invention makes use of the recognition that, up to a certain distance of the child from the supervising person, it is not necessary to know exactly where the child actually is. For example, in a radius of 5 m around the supervising person, the child can also be found again quickly after it has been lost sight of. Only when the child moves further away does the risk exist that the child will become lost. In the system in accordance with the invention, a warning signal is now output as soon as the child moves further way so that a reaction can be immediate and the child can still be found again in good time.

Corresponding considerations apply to adults requiring supervision. The system in accordance with the invention can in particular be used in homes in which the persons requiring supervision can move freely. If the person now leaves the home and moves further away from it than the predetermined value, the warning signal is output and measures can be taken immediately to find the person again and to bring them back to the home and to keep them from injury. The permissible distance can be set correspondingly bigger here.

It is particularly preferred for the value of the permissible distance to be adjustable. The monitoring can thereby be matched to the respective circumstances. For example, in a department store, a lower permissible distance can thus be set than in a playground. The supervising person is thereby only warned when there is actually the risk of a child being lost or being endangered.

In accordance with a further embodiment of the invention, means are provided by which the output of the warning signal is ended again when the distance again falls below the pre-determined value. The supervising person can thus be signaled that the person to be monitored is again within the pre-determined distance. The finding is thereby made easier.

The transmitter and/or the receiver are preferably battery operated. There is thereby no dependence on a mains supply.

The operating life of these devices is advantageously increased by the transmitter and/or the receiver being able to be switched on and off.

To reduce the construction size of the transmitter and/or receiver, these devices preferably have a board using SMD technology. In addition, the transmitter can have a printed-on antenna for this purpose.

The transmitter and the receiver preferably operate according to the radio principle, in particular with radio frequency modulation. This has proved to be particularly suitable for the present application.

It is particularly advantageous if the transmitter and/or the receiver have a housing made of plastic. The radio transmission is thereby possible largely without hindrance.

Both an optical and an acoustic signal, or both, can be provided as the warning signal. It is preferred for the warning signal to change, for example to become louder or faster, as the distance between the transmitter and the receiver increases. It is also possible to provide a plurality of light-emitting diodes of which a number increasing with the distance is activated. The supervising person thereby receives additional information, on the one hand. The attention value of the warning signal is thereby increased, on the other hand, so that the supervising person can react faster.

Three light-emitting diodes can, for example, be provided in the receiver, of which one lights up at a free distance of 5 m, two light up at a free distance of 10 m and all three light up at a free distance of 15 m. If the free connection between the transmitter and the receiver is interrupted, for example by a wall, the distances at which the respective light-emitting diodes light up become correspondingly smaller.

It is furthermore advantageous for the receiver to be able to be switched into a mode in which the warning signal becomes more intense, in particular louder or faster, as the distance decreases. This mode is selected as soon as a warning signal has been output and the person should now be located using the transmitter. The increasing intensity of the signal as the distance decreases facilitates the location in the manner of a bearing.

A further possibility lies in the fact of sending a message, in particular to a land line or mobile telephone, for example by SMS (short message service) or as an e-mail to a computer, when the pre-determined distance is exceeded. Other persons, or also a plurality of persons simultaneously, can thus be informed. It is preferred for the transmitter and/or the receiver to be suitable for GSM (global system for mobile communication). The system can thereby also be used beyond national borders.

A message can finally also be transmitted as an emergency call to a police station. In special cases, or when a particularly large distance is exceeded, a police response can thereby be triggered fast.

In accordance with an embodiment of the invention, the receiver is like-wise made portable. This embodiment is in particular sensible for the monitoring of children by supervising persons who want to move freely with the children.

In accordance with a further embodiment of the invention, the receiver is fixedly installed. This embodiment is in particular sensible for the monitoring of adults requiring supervision who are resident in a home. No portable receiver is required here.

In this application, it is moreover advantageous for the receiver to have a plurality of channels for different transmitters. A plurality of persons can thereby be monitored with one receiver.

In accordance with a further embodiment of the invention, the transmitter has a pin-on device or a fastening band. The transmitter can thus be fastened to the person to be monitored fast and simply.

When the system is used to monitor children, it is preferred for the transmitter to have a housing with a shape which appeals to children, for example a moon shape or a star shape. The acceptance of the device among the children is thereby increased.

Embodiments of the invention are shown in the drawing and will be described in the following. There are shown, in each case in a schematic representation:

FIG. 1 a portable transmitter and a portable receiver; and

Figure 1:
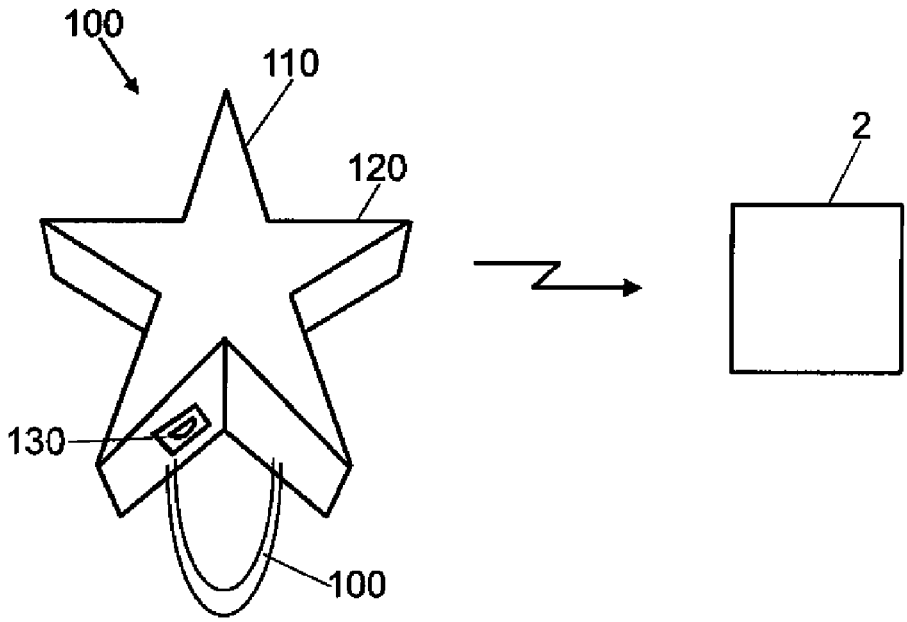

The transmitter 1 shown in FIG. 1 is formed in as small a manner as possible and is provided with a fastening device 100, for example a clip or a band (Shown in FIG. 1) in order to be able to be fastened to a person, for example the jacket or the wrist of a child. The housing 110 of transmitter 1 may have a shape, such as star 120, that is appealing to children. The transmitter 1, for example, has a diameter of 0.5 to 0.7 cm and has a weight of approximately 20 g. To be able to form the transmitter 1 in as small a manner as possible, it includes a board 200 with a circuit using SMD technology as well as a small battery 205 for the power supply. The antenna 210 is preferably printed onto the transmitter board 200.

The receiver 2 is shown in FIG. 1 can like be made portable and have a small size. For this purpose, it can likewise have a board 300 with a circuit using SMD technology as well as a small battery 310 for the power supply. The receiver can also be provided with a printed-on antenna 305. The receiver 2 can, however, also be made somewhat larger than the transmitter 1.

The transmitter 1 and the receiver 2 in particular work together in accordance with the radio principle, with the radio waves preferably being radio frequency modulated. Reception is thereby also ensured with obstacles between the transmitter 1 and the receiver 2. The receiver 2 includes a warning device 320 which is activated as soon as the distance between the transmitter 1 and the receiver 2 exceeds a pre-determined value which can in particular be adjustable. The warning signal output by warning device 320 can be both of an optical and of an acoustic type and can depend on the magnitude of the distance between the transmitter 1 and the receiver 2. A set distance can amount, for example, to 5 to 15 m. The operating life of the transmitter 1 and of the receiver 2 can amount, for example, to three hours. The power source can also be made rechargeable.

Figure 2:
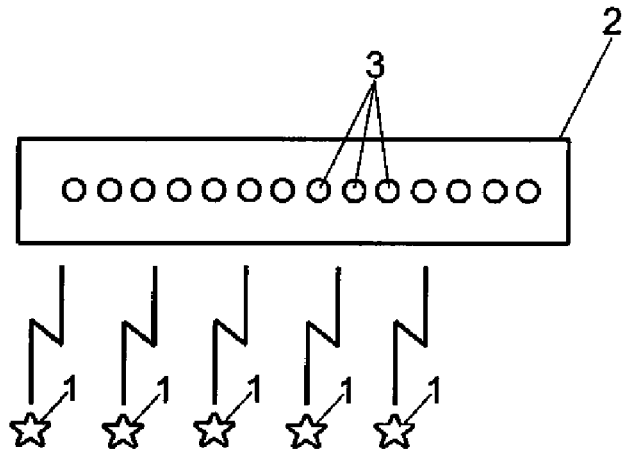
FIG. 2 is a fixedly installed receiver with a plurality of portable transmitters.
Figure 3:
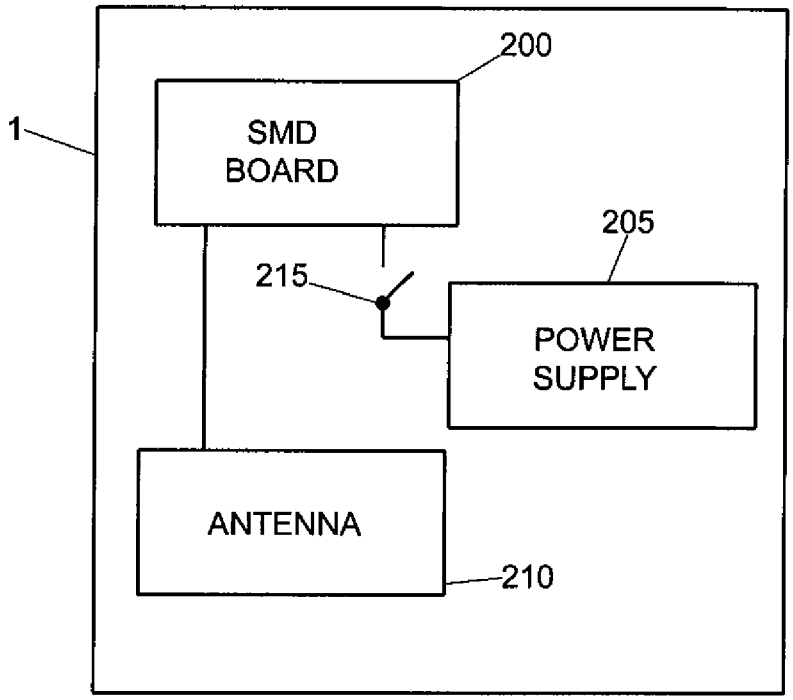
FIG. 3 is a block diagram of circuitry of a transmitter.
Figure 4:
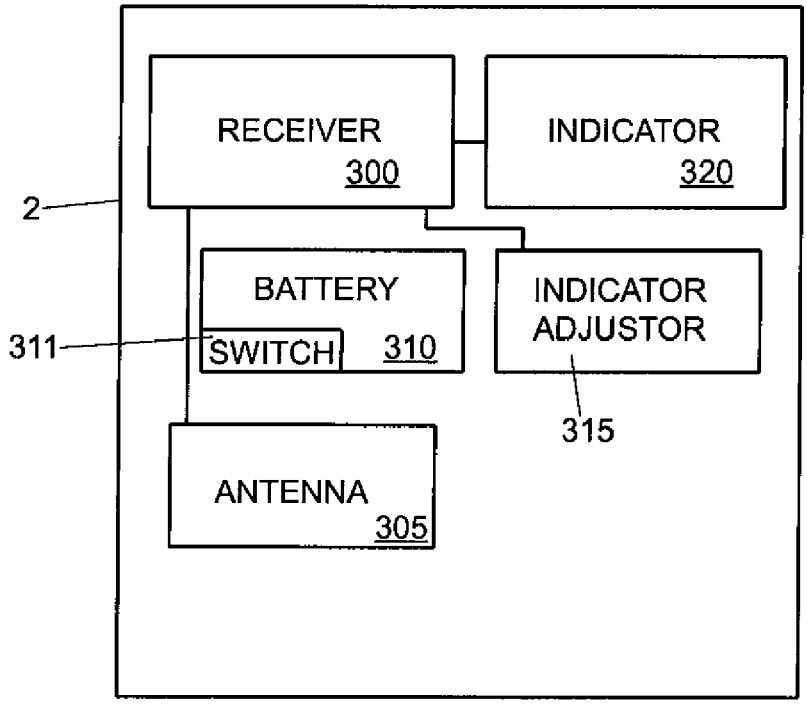
FIG. 4 is a block diagram of circuitry of a receiver.

In the variant shown in FIG. 2, the receiver 2 is fixedly installed and has a plurality of channels which are each associated with one of a plurality of transmitters 1. Each channel moreover has an optical warning device 3, for example a warning lamp, associated with it. Furthermore, the receiver 2 can have an acoustic warning device for all channels jointly. While the acoustic warning device serves to attract the attention of the supervising person, the latter can determine via the optical warning devices 3 which of the transmitters 1 has resulted in an output of the warning signal. The supervising person can thus recognize which monitored person has moved further away than the pre-determined value.

This variant can in particular be used sensibly for the monitoring of persons requiring supervision. The permissible distance can be larger than, for example, 30 m. The distinguishing of the different transmitters 1 can also take place in a different manner.

A particularly advantageous monitoring of persons is made possible with the system in accordance with the invention which gives the monitored person a degree of mobility which is as large as possible without requiring a permanent supervision of the person, but simultaneously ensuring a sufficient monitoring. The supervising person is reliably informed of a moving away and can react quickly in order to locate the monitored person and to keep them from danger.

The invention claimed is:

1. A system for the monitoring of persons, in particular of children and adults requiring supervision, comprising a portable transmitter, a receiver and a warning device provided at the receiver as well as means by which the warning device is caused to output a warning signal when the distance between the transmitter and the receiver exceeds a pre-determined, adjustable value, wherein the receiver can be switched into a mode in which the warning signal becomes more intense, wherein said warning signal becomes one of louder and faster, as the distance between the receiver and transmitter decreases.

2. The system in accordance with claim 1, wherein means are provided by which the output of the warning signal is ended again when the distance falls below the predetermined value again.

3. The system in accordance with claim 1, wherein at least one of the transmitter and the receiver are battery operated.

4. The system in accordance with claim 1 wherein at least one of the transmitter and the receiver can be switched on and off.

5. The system in accordance with claim 1 wherein at least one of the transmitter and the receiver have a board with a circuit using SMD technology.

6. The system in accordance with claim 1 wherein at least one of the transmitter and the receiver have a printed-on antenna.

7. The system in accordance with claim 1 wherein the transmitter and the receiver operate according to the radio principle, with radio frequency modulation.

8. The system in accordance with claim 1 wherein at least one of the transmitter and the receiver have a housing made of plastic.

9. The system in accordance with claim 1 wherein at least one of an optical warning signal and an acoustic warning signal is provided.

10. The system in accordance with claim 1 wherein the warning signal changes, said changes including at least one of said warning signal becoming louder and said warning signal becoming faster, as the distance between the transmitter and the receiver increases.

11. The system in accordance with claim 1 wherein the receiver has a plurality of light-emitting diodes of which the more light up, the further the transmitter is away from the receiver.

12. The system in accordance with claim 11 wherein the said plurality of light-emitting diodes includes at least three light-emitting diodes.

13. The system in accordance with claim 11 wherein one light-emitting diode lights up at a distance between the receiver and transmitter of 5 meters, two light emitting diodes light up at a distance between the receiver and transmitter of 10 meters and three-light emitting diodes light up at a distance between the receiver and the transmitter of 15 meters.

14. The system in accordance with claim 1 wherein when a pre-determined distance is exceeded, a message is sent.

15. The system in accordance with claim 14 wherein said message is sent to at least one of a land telephone line, a mobile telephone, and as an e-mail to a computer.

16. The system in accordance with claim 15 wherein said message sent to said mobile telephone is by SMS.

17. The system in accordance with claim 1 wherein at least one of the transmitter and the receiver are suitable for GSM.

18. The system in accordance with claim 1 wherein an emergency call is made to a police station.

19. The system in accordance with claim 1 wherein the receiver is portable.

20. The system in accordance with claim 1 wherein the receiver is fixedly installed.

21. The system in accordance with claim 1 wherein the receiver has a plurality of channels for different transmitters.

22. The system in accordance with claim 1 wherein the transmitter has one of a pin-on device and a fastening band.

23. The system in accordance with claim 1 wherein the transmitter has a housing with a shape appealing to children.

24. The system in accordance with claim 23 wherein said shape is one of a moon shape and a star shape.

* * * * *